United States Patent [19]

Miller

[11] Patent Number: 4,581,865

[45] Date of Patent: Apr. 15, 1986

[54] INSULATING WINDOW SYSTEM

[76] Inventor: William Miller, 4330 Hubbell, Des Moines, Iowa 50317

[21] Appl. No.: 652,729

[22] Filed: Sep. 21, 1984

[51] Int. Cl.[4] ..... E06B 3/26

[52] U.S. Cl. ..... 52/202

[58] Field of Search ..... 52/202, 203, DIG. 13, 52/DIG. 4; 160/391, 392, 393, 394, 395, 396, 397, 398, 399

[56] References Cited

U.S. PATENT DOCUMENTS

| | | | |
|---|---|---|---|
| 2,667,245 | 1/1954 | Shink | 52/202 |
| 4,044,813 | 8/1977 | Emmons | 52/202 X |
| 4,121,379 | 10/1978 | Everson | 52/202 X |
| 4,189,880 | 2/1980 | Ballin | 52/202 |
| 4,387,541 | 6/1983 | Boomershine | 52/202 |
| 4,399,640 | 8/1983 | Porter | 52/202 |

*Primary Examiner*—John M. Jillions
*Assistant Examiner*—Lynn M. Sohacki
*Attorney, Agent, or Firm*—James D. Birkenholz

[57] ABSTRACT

An insulating window system is provided wherein a window track is secured on a frame outlining the window. The window track includes a pair of spaced jaws defining between them a channel with a semi-oval cross-section. A glazing frame having a base member with two outwardly extending arms for engaging the inside surface of the jaws, and securing the frame arm to the track. An insulating strip extends between the arms and fills the space not occupied by the arms when they engage the jaws within the channel. The glazing frame includes a pane holder which includes the base section of the jaws and a face section overlaying the back and connected thereto by an end section, all forming a glazing channel into which the glazing pane sets.

4 Claims, 6 Drawing Figures

INSULATING WINDOW SYSTEM

BACKGROUND OF THE INVENTION

1. Field of the Invention

The present invention relates generally to windows and more particularly to a removable energy insulating window for attachment to either the inside or outside of a structural window.

2. Description of the Prior Art

In recent years because of the rapidly increasing energy costs, home and commercial buildings, energy conservation has become a national concern. The largest energy comsumption normally occurs in heating and cooling of the air within the structure. Typically, air energy conservation measures include insulating and weatherproofing of the structure. However, with respect to windows, it is often extremely difficult or impossible to insulate the window and because of the lack of consistant uniformability in the size, configuration and building construction, retroughing of the complete window with state of the art units becomes very costly, if not impossible.

Presently there exists methods of installing sheet plastic-like material over the window by attaching to the side of the window to provide a barrier to the free flow of air around and thru the window. However, this approach does not permit opening of the window until the material is removed. Typically the material is only usable for one application and visibility through the material is often times significantly diminished.

Further, other techniques permit the fastening of sheets of translucent material onto the window structure, however, many of the previous problems exist as well as unsightly holding brackets with nails and/or wood screws severely marring the frame surface.

Thus, there is a need for an economical energy efficient window system which may be easily adopted to any style-design of window. The system should be reusable from one season to the next and be attachable to the existing window either on the inside or outside, providing clear visability through the window and not destroy or damage the existing window structure.

SUMMARY OF THE INVENTION

An insulating window system having a window track secured to a frame outlining a window. The track having a pair of spaced jaws extending outward from the window and defining a channel between them with a partial semi-oval cross-section. A glazing frame having a base member with two outwardly extending arms for engaging the inside surface of the jaws when the glazing frame is pushed against the window track. An insulating strip extends the length of the glazing frame and fills the area not occupied by the arms when they engage the jaws within the channel. A pane holder extending from the glazing frame which includes the base member of the arms and a face section overlaying the back and connected thereto by an end section, all forming a glazing channel into which a glazing pane is held in place. The face section is slightly concave towards the base member without the glazing pane inserted and exerts inwardly directed pressure toward the window on the glazing pane upon insertion of the glazing pane. The glazing pane once inserted in the pane holder is held securely against the window.

DESCRIPTION OF THE DRAWINGS

FIG. one illustrates a side elevational perspective view of the insulating window system of the present invention with the glazing frame illustrated away from the window; and FIG. two of an expanded cross-sectional perspective view of the compenents of the present illustrating removal of the adhesive tape backing; and FIG. three is a partial cross-sectional view taken along lines 3—3 of FIG. 1; and FIG. four is a partial cross-sectional view of the insulating window system secured to a window; and FIG. five is an enlarged partial cross-sectional view of the insulating window system; and FIG. six is a partial cross-sectional view of the glazing frame taken along lines 6—6 of FIG. 2.

DESCRIPTION OF THE PREFERRED EMBODIMENT

Figure 1:
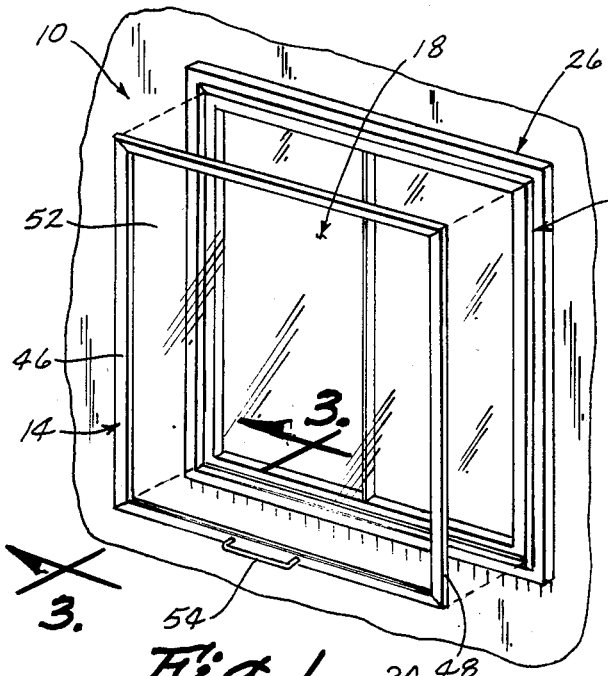
Figure 3:
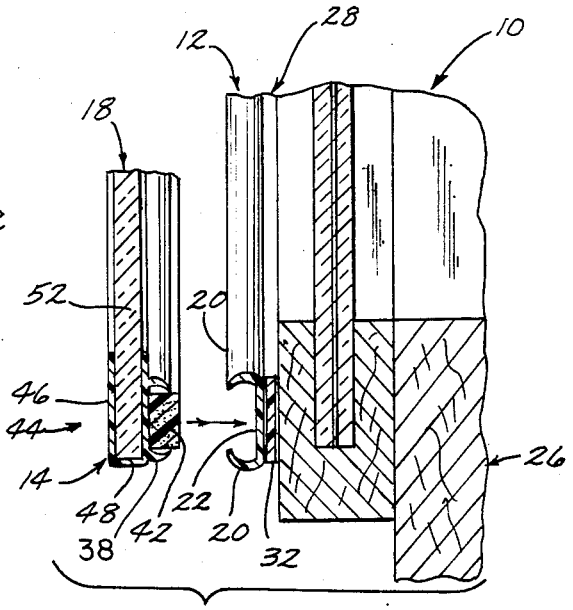
Figure 2:
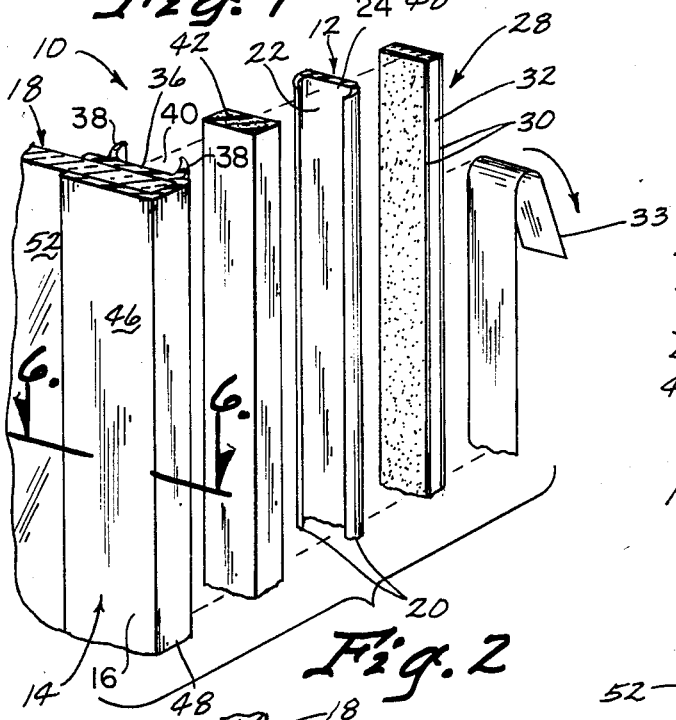
Figure 4:
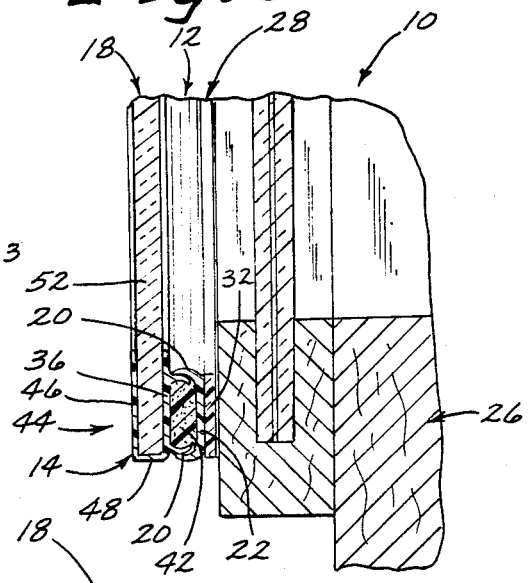

Referring now to the drawings wherein like reference numerials designated identical or corresponding parts throughout the several views, the insulating window system of the present invention is illustrated generally at 10 of FIG. 1. The window system 10 (FIGS. 1–6) includes generally a window track 12 with a glazing frame 14 attached thereto and a pane holder 16 for securing a glazing pane 18 against the window track 12.

Specifically, the window track 12 (FIGS. 2–5) includes a pair of spaced jaws 20 extending outward from a back portion 22. The jaws 20 are concaved and form a channel 24 therebetween with the track 12 being semi-oval in cross section. The track 12 is secured to a window 26 by conventional double faced cushioned adhesive tape 28. The tape 28 includes an adhesive material 30 on both sides which is covered by a pull away strip 33 with a resilient core 32 therebetween. In application, the pull away strip 33 (FIG. 2) is removed from the tape 28 with one side of the tape 28 contacting the back 22 of the track 12 and the other side of the tape 28 contacting the outside edge of the window 26. Typically, four sections of track 12 are utilized to completely encircle the window structure, all mounted in the same verticle plane with the corner of the track 12 mitered cut to form a continuous outline around the window 12. Other type of fasteners than the tape 28 may be utilized, however, many typically will mar and disfigure the window 26 upon their removal which is not desired.

Figure 6:
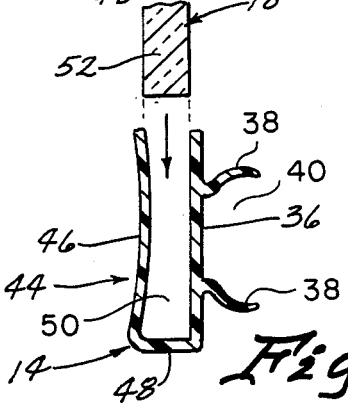
Figure 5:
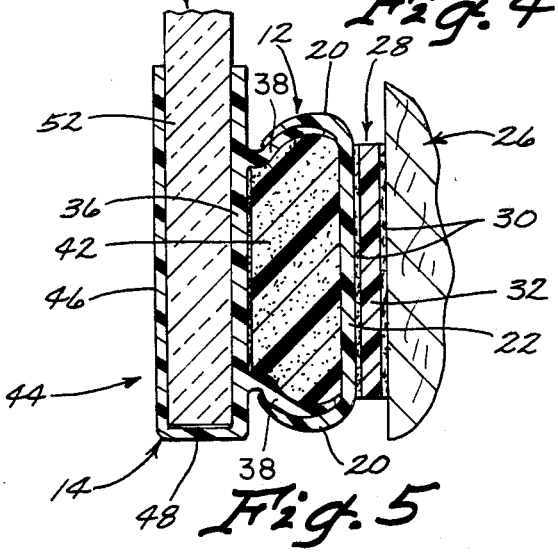

The glazing frame 14 (FIGS. 2–6) includes a base member 36 with two spaced inwardly extending arms 38. The arms 38 are concaved in shape and form a channel 40 between them. The arms 38 are spaced apart and shaped to mateably slide inside the jaws 20 (FIGS. 3–5) when the glazing frame 14 is pressed against the window track 12 with the tips of the arms 36 inside the jaws 20. The jaws 20 exert an inward force on the arms 38 thus holding the glazing frame 14 securely against the window track 12. An insulating strip 42 fills the channel 40 and forms an air seal when the glazing frame 14 is pressed onto the window track 12, by contacting both arms 38, the base member 38 and the back portion 22 of the window track 12. A paine holder 44 (FIGS. 2–6) extends opposite the arms 38 of the glazing frame 14 and includes the base member 38, an overlaying face section 46 interconnected by an end section 48. The base member 38 adjacent face section 46 and end section 48 all form a paine channel 50 into which a glazing paine 52 is inserted and held in place. The face section 46 (FIG. 6)

is slightly concave towards the base member 38 when the glazing paine 52 is not inserted, thus exerting an inwardly directed pressure against the pane 52 to securely hold the pane 52 in position. A handle 54 (FIG. 1) at the bottom of the window 10 assists in handling the window during removal and reinstallation.

In installation of the insulating window system 10, the window track 12 is first applied to the window 26 by attaching one side of the tape 28 to an outside path around the window 26 in a common vertical plane with the other side of the tape 28 attaching to the track 12. The glazing frame 14 is cut to the same dimensions as the window track 12 and slipped over an appropriately sized glazing pane 52 wherein the glazing frame 14 is pushed onto the window track 12 and held securily in place therewith the interaction of the jaws 20 and arms 38. The window track 12 and glazing frame 14 are suitable for manufacturing by plastic injection molding with the insulating strip 42 comprised of insulative flexible material which is readily available. The window system 10 is further adapted to be mounted either on the inside or outside of an existing structural window, and in instances where needed may be double stacked to provide more energy savings.

Obviously, many modifications and variations of the present invention are possible in light of the above teachings. It is therefore to be understood that, within the scope of the appended claims, the invention may be practiced otherwise than as specifically described.

I claim:

1. An insulating window system for use with existing structural windows, comprising:

a window track, said track secured to and outlining the structural windows and includes a jaw means, the jaw means includes a pair of spaced jaws, the jaws extending outward from the track and being concaved towards each other forming a semi-oval channel;

a glazing frame means having a base member and a pane holder, the base member having two outwardly extending spaced arms, the arms being concaved towards each other forming a semi-oval channel and engaging the jaws when passed there against, for locking the window track and glazing frame means together;

the pane holder extending from the glazing frame means and includes an end section and a face section, the face section overlaying the base member with the end section extending therebetween, all forming a glazing channel for securing a glazing pane.

2. An insulating window system as claimed in claim 1, wherin the face section of the glazing frame means is concaved towards the back section when the glazing pane is not occupying the glazing channel to provide an inwardly directed pressure against the glazing pane upon insertion of the glazing pane.

3. An insulating window system as claimed in claim 1 further including an insulative strip in the channel between the arms of the glazing frame means.

4. An insulating window system as claimed in claim 1 wherein the window track is adhesively secured to the structural window by double faced tape wherein one side of the tape contacts the window structure and the other side contacts the track.

* * * * *